US006155070A

United States Patent [19]

Rust, Jr. et al.

[11] Patent Number: 6,155,070

[45] Date of Patent: Dec. 5, 2000

[54] DOOR INSULATION RETAINER

[75] Inventors: Raymond A. Rust, Jr., Gosport; Jennifer L. Eisberg, Greenwood; Timothy J. Schnell, Clayton; Paul W. Nelson, Carmel, all of Ind.

[73] Assignee: Carrier Corporation, Syracuse, N.Y.

[21] Appl. No.: 09/359,886

[22] Filed: Jul. 26, 1999

[51] Int. Cl.[7] ..... F25D 17/06

[52] U.S. Cl. ..... 62/404; 49/501

[58] Field of Search ..... 62/404; 49/501; 52/406.2, 406.3, 407.2, 404.2, 794.1; 248/219.3, 220.42, 222.13, 225.11, 228.2, 247, 297.21

[56] References Cited

U.S. PATENT DOCUMENTS 2,893,220 7/1959 Blum ..... 62/404

FOREIGN PATENT DOCUMENTS 469177 2/1969 Germany ..... 49/501

5943872 8/1999 Japan ..... 62/404

*Primary Examiner*—William Doerrler

*Assistant Examiner*—Mohammad M. Ali

[57] ABSTRACT

A method and apparatus for retaining an insulation blanket in its installed position on the inner surface of a fan coil door in the vicinity of a negative pressure created by a blower assembly within the fan coil. A bracket is secured to the lower edge of the blower assembly access door, the bracket having an upwardly extending flange that overlaps a significant portion of the insulation blanket to hold it in its installed position. A pair of obliquely extending tabs engage a shelf surface on the lower edge of the door to secure the bracket to the door without the use of fasteners.

15 Claims, 2 Drawing Sheets

DOOR INSULATION RETAINER

This invention relates generally to air conditioning equipment and more particularly to a bracket for retaining the insulation on the door of a fan coil unit.

BACKGROUND OF THE INVENTION

The temperatures within a fan coil are commonly below the dew point of a room in which the air is being conditioned. Thus, in order to prevent "sweating" of the casing, it is common to provide insulation on the inner side of the casing and the doors. Such insulation is usually applied by way of an appropriate adhesive for securing the insulation to the walls and doors of the casing. Further, an adhesive is also commonly used to attach a foil facing to the inner side of the insulation.

It has been found that the insulation attached to the door of the blower compartment of a fan coil tends to be pulled away from the door by the negative pressure created by the blower fan and the high velocity air flow passing the insulation edge. This can occur in various degrees depending on the strength and effectiveness of the adhesives. That is, the inner foil may tend to separate from the insulation and if that occurs, the insulation blanket tends to delaminate. In either case, the foil and/or the insulation itself may be drawn into the blower so as to cause blower motor problems or air flow obstruction. Further, if the adhesion between the insulation and the sheet metal door is not adequate, entire sections of the insulation blanket may be pulled off by the negative pressure and drawn into the blower. Then, in addition to the problems discussed hereinabove, the sheet metal door is exposed to the cooler temperatures and "sweating" will occur, thus causing possible damage to the facility in which the system is installed.

Although changing from a pressure sensitive adhesive to thermal set adhesive has improved the adhesion, separation can still occur. The use of tape to secure the insulation in place is also a possible solution but has not been found to be a reliable fix.

Fasteners can also be used to secure the insulation to the door, but one must avoid the unnecessary compression of the insulation which will affect its performance. Further, one does not want to complicate the manufacturing process with the use of labor intensive fasteners.

It is therefore an object of the present invention to provide an improved fan coil unit.

Another object of the present invention is the provision in a fan coil unit for an improved installation of insulation.

Yet another object of the present invention is the provision in a fan coil unit for decreased damage due to unit "sweating" and insulation being pulled into the blower.

Still another object of the present invention is the provision in a fan coil for an improved method and apparatus for installing insulation in the blower door.

Those objects and other advantages become more readily apparent upon reference to the following description when taken in conjunction with the appended drawings.

SUMMARY OF THE INVENTION

Briefly, in accordance with one aspect of the invention, a bracket is attached to the lower edge of a blower door, with a upwardly extending flange in overlapping relationship with the insulation so as to hold the insulation in place.

By another aspect of the invention, the bracket is secured to the door by way of a U-shaped element that fits over a downwardly extending flange on the end of a shelf on which the insulation rests. A pair of oblique barbs extending from the bracket flange secures the bracket in place by engaging the upper surface of the shelf, thus obviating the need for fasteners.

In the drawings as hereinafter described, a preferred embodiment is depicted. However, various other modifications and alternate constructions can be made thereto without departing from the true spirit and scope of the invention.

DESCRIPTION OF THE PREFERRED EMBODIMENTS

Figure 1:
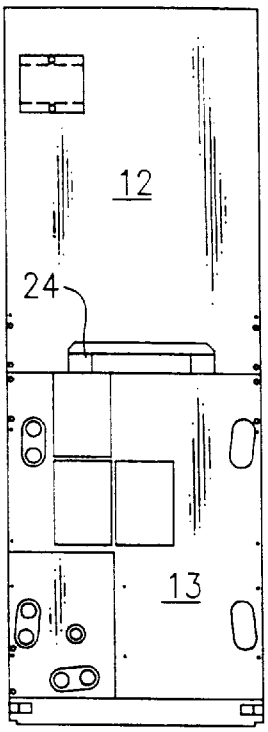
FIG. 1 is a view of a fan coil unit with the two doors closed.
Figure 1A:
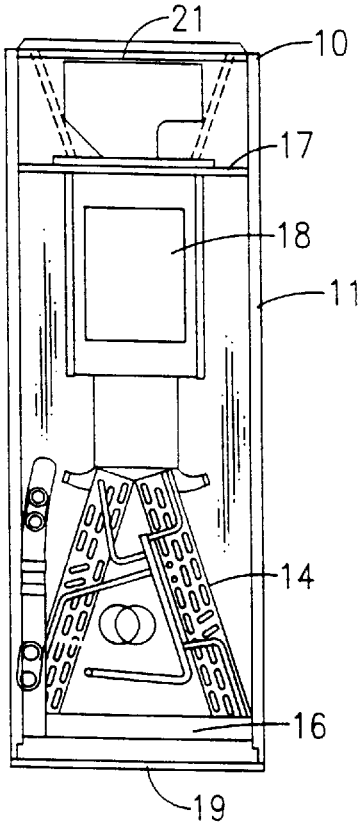
FIG. 1A is a view of a fan coil unit with the two doors removed from their installed positions.

Referring now to FIG. 1, there is shown a fan coil unit 10 having a cabinet 11, upper door 12, and lower door 13. A heat exchanger coil 14 and its associated drain pan assembly 16 are mounted in the lower section of the cabinet 11. The coil 14 is connected within a refrigerant flow circuit, which includes a condenser and a compressor (not shown) in a conventional manner.

In the upper portion of the cabinet 11 is a blower deck 17 from which there is suspended a blower assembly 18. In operation, the blower assembly 18 draws the air from the inlet end 19 of the cabinet 11, through the coil 14 through the blower assembly 18 and out the exit end 21 of the cabinet 11. It will thus be recognized that a negative pressure exists within the cabinet 11 because of the operation of the blower assembly 18. It is this negative pressure and the high velocity air flow that exacerbates the problem addressed by the present invention.

Figure 2:
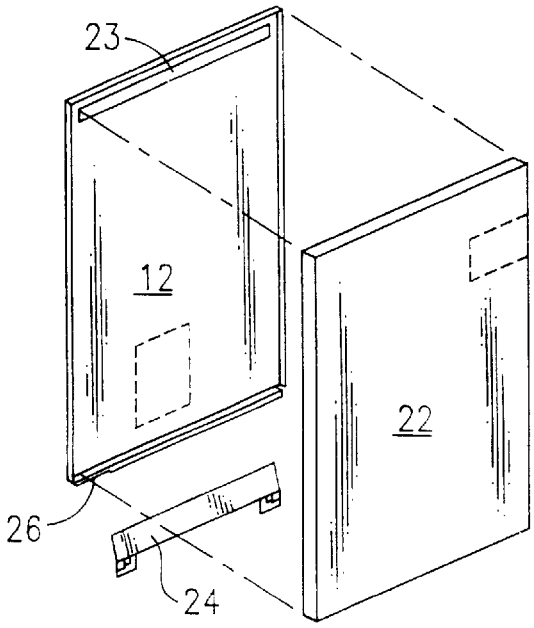
FIG. 2 is an exploded view of the front door with the insulation and bracket of the present invention being separated therefrom.

The upper door 12 is shown in FIG. 2 with an insulation blanket 22 being secured to its inner side by an adhesive. Examples of materials that are used for this purpose are hot melt adhesives and water based adhesives. The insulation blanket 22 has a foil material on its inner surface for the purpose of sealing the surface of the insulation. A gasket 23 is secured to the inner side of the door 12 near its upper edge for purposes of engaging the upper edge of the cabinet 11 in a sealing relationship. The blower deck 17 engages the inner side of the insulation blanket 22 for purposes of holding it in place in the vicinity of the low pressure condition which is created by the blower assembly 18. Similarly, the coil 14 is in contact with the insulation blanket attached to the lower door so that, in addition to the adhesive, the coil 14 tends to exert pressure against the insulation blanket in order to hold it is place. This is not the case with the lower end of the blanket 22 attached to the upper door 12. Here, because it is in the near vicinity of the blower with no positive pressure being exerted thereon to hold it in place, it tends to be drawn away from the door 12 toward the blower assembly 18. Thus, the bracket 23 is attached to the lower edge 24 of the door 12 in order to hold the insulation blanket 22 in its installed position.

Figure 3:
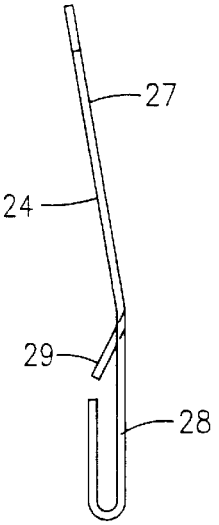
FIG. 3 is a side view of the bracket of the present invention.
Figure 4:
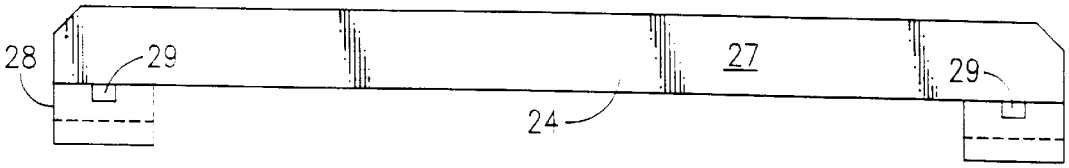
FIG. 4 is a top view thereof.

The bracket 24 is shown in greater detail in FIGS. 3 and 4. It includes a planar body 27 whose length extends across a substantial portion of the width of the upper door 12. The body 27 has its upper corners removed as shown to facilitate unrestricted engagement of the body 27 with the insulation blanket 22. Depending from the lower edge of the body 27 are a pair J-hooks 28 for securing the bracket 24 to the door lower edge 26. As will be seen, the body 27 is interconnected with the J-hooks 28 at a slight angle so as to align the body 27 with its top edge angled slightly inwardly toward the door 12 when the bracket 24 is in its installed position. Associated with each of the J-hooks 28 is a tab 29, which extends downwardly at an oblique angle with its end extending toward the open end of the J-hook 28. The tabs 29 are designed to hold the bracket 24 in its installed position without the use of fasteners.

Figure 5:
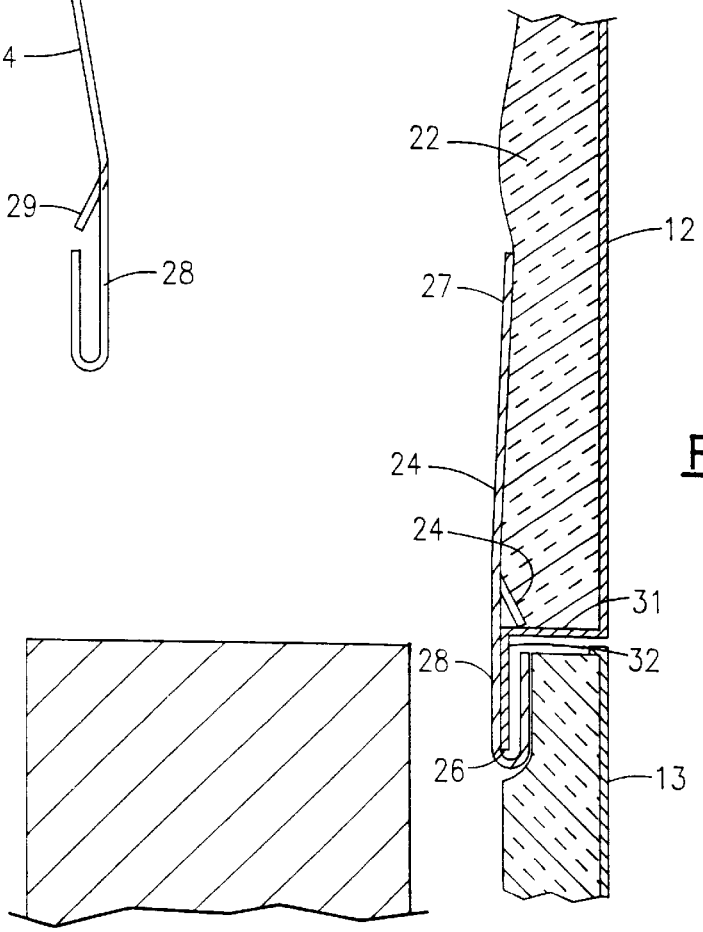
FIG. 5 is a fragmented view of the inventive bracket in its installed position.

Referring now to FIG. 5, the bracket 24 is shown in its installed position as attached to the upper door 12. As will be seen, the door 12 has a lower horizontal flange 31 which extends inwardly, with a downwardly extending leg 32 which terminates at the door lower edge 26. The insulation blanket 22 rests on the lower flange 31 and is attached to the sheet metal door 12 by way of an adhesive. The bracket 24 is installed by bringing the J-hooks 28 up under the door lower edge 26, with the body 27 engaging the insulation blanket 22, causing a slight impression thereof. The tabs 29 pass over the flange 31, with the ends of the tabs 29 engaging the upper surface of the lower flange 31 so as to hold the bracket 24 in its installed position. As will be seen, the J-hooks 28 tend to slightly compress the upper portion of the insulation blanket that is attached to the lower door 13.

In this way, the insulation blanket 22 is held in its installed position by way of the bracket 24 and prevents the lower portion of the blanket 22 from being drawn away, in whole or in part, from its position as secured to the upper door 12.

Although the present invention has been shown and described with respect to a preferred embodiment, it will be understood by those skilled in the art that various changes in the form and detail thereof can made without departing from the true spirit and scope of the claimed invention. For example, although the invention has been described in terns of use with an up flow fan configuration, it would be equally applicable to a down flow configuration.

What is claimed is:

1. A fan coil comprising:

a housing;

a heat exchanger coil disposed within said housing, said coil having provision for circulating refrigerant therethrough;

a blower disposed within said housing for causing air to pass though said coil in heat exchange relationship therewith, thereby creating an air flow within said casing;

a door disposed in said housing for providing access to said blower;

insulation attached to an inner surface of said door; and a bracket attached to said door for holding said insulation against said door so as to prevent it from being pulled away by said air flow.

2. A fan coil as set forth in claim 1 wherein said bracket is attached to said door without fasteners.

3. A fan coil as set forth in claim 1 wherein said bracket is attached to a lower edge of said door.

4. A fan coil as set forth in claim 3 wherein said bracket includes at least one J-hook that hooks over said door lower edge.

5. A fan coil as set forth in claim 1 wherein said door includes an inwardly extending flange at one edge thereof.

6. A fan coil as set forth in claim 5 wherein said bracket includes at least one tab that engages a surface of said inwardly extending flange for retaining said bracket in its installed position.

7. An improved fan coil of the type having an installed blower for creating a negative pressure within the fan coil and an access door with insulation applied to the inner surface thereof, wherein the improvement comprises:

a bracket attached to said door and having an upwardly extending flange in overlapping relationship with said insulation so as to hold the insulation in place.

8. An improved fan coil as set forth in claim 7 wherein said bracket is attached to said door without fasteners.

9. An improved fan coil as set forth in claim 7 wherein said bracket is attached to a lower edge of said door.

10. An improved fan coil as set forth in claim 8 wherein said bracket includes as least one J-hook that hooks over said door lower edge.

11. An improved fan coil as set forth in claim 7 wherein door includes an inwardly extending flange at one edge thereof.

12. An improved fan coil as set forth in claim 11 wherein said bracket includes at least one tab that engages a surface of said inwardly extending flange for retaining said bracket in the installed position.

13. A method of retaining an insulation blanket in its installed position on the inner surface of a fan coil door in the vicinity of air flow caused by a blower assembly, comprising the steps of:

attaching said insulation blanket to said door with an adhesive;

attaching a bracket to one edge of said door, said bracket having a body which extends in overlapping and contacting relationship with a portion of said insulation blanket so as to hold it in place against said door.

14. A method as set forth in claim 13 and including the step of providing a J-hook on said bracket and installing said J-hook over a lower edge of said door.

15. A method as set forth in claim 13 and including the steps of:

providing an inwardly extending flange on an edge of said door;

providing at least one tab on said bracket; and installing said bracket with its tab resting on said inwardly extending flange to hold said bracket in its installed position.

* * * * *